United States Patent [19]

Englund

[11] Patent Number: 5,052,901

[45] Date of Patent: Oct. 1, 1991

[54] LIFT VALVE IN A ROTARY SCREW MACHINE

[75] Inventor: Arnold Englund, Spånga, Sweden

[73] Assignee: Svenska Rotor Maskiner AB, Stockholm, Sweden

[21] Appl. No.: 601,687

[22] PCT Filed: Apr. 24, 1989

[86] PCT No.: PCT/SE89/00227

§ 371 Date: Oct. 23, 1990

§ 102(e) Date: Oct. 23, 1990

[87] PCT Pub. No.: WO89/10489

PCT Pub. Date: Nov. 2, 1989

[30] Foreign Application Priority Data

Apr. 25, 1988 [SE] Sweden ..... 8801524

[51] Int. Cl.[5] ..... F04B 49/00; F04B 17/04; F04B 23/00; F01C 1/16

[52] U.S. Cl. ..... 417/310; 417/440; 417/418; 418/201.2

[58] Field of Search ..... 417/310, 440, 418; 418/201.2

[56] References Cited

U.S. PATENT DOCUMENTS

| | | | |
|---|---|---|---|
| 3,869,227 | 3/1975 | Kocher et al. | 418/201.2 |
| 3,877,846 | 4/1975 | Lundberg | 417/440 |
| 4,575,323 | 3/1986 | Yoshimura | 417/440 |
| 4,946,362 | 8/1990 | Söderlund et al. | 418/201.2 |

*Primary Examiner*—Leonard E. Smith
*Assistant Examiner*—Alfred Basichas
*Attorney, Agent, or Firm*—Frishauf, Holtz, Goodman & Woodward

[57] ABSTRACT

The invention relates to a pressure actuated lift valve in a rotary screw machine mounted in one of the end walls of the machine, e.g. for the purpose of controlling the built-in volume ratio of the machine. The valve contains a cylindrical valve member 11 displaceable in an axial boring 13 and an actuating piston 12 in a cylinder 14. The boring 13 extends between the working space 24 of the machine and said cylinder 14. Through channels 20, 21, 22 pressure fluid is supplied to the cylinder 14 whereby the actuating piston 12 affects the valve member 11 to take an open or a closed position.

By making the actuating means as a unit separate from the valve member 11 the manufacture is facilitated.

5 Claims, 1 Drawing Sheet

LIFT VALVE IN A ROTARY SCREW MACHINE

Figure 1:
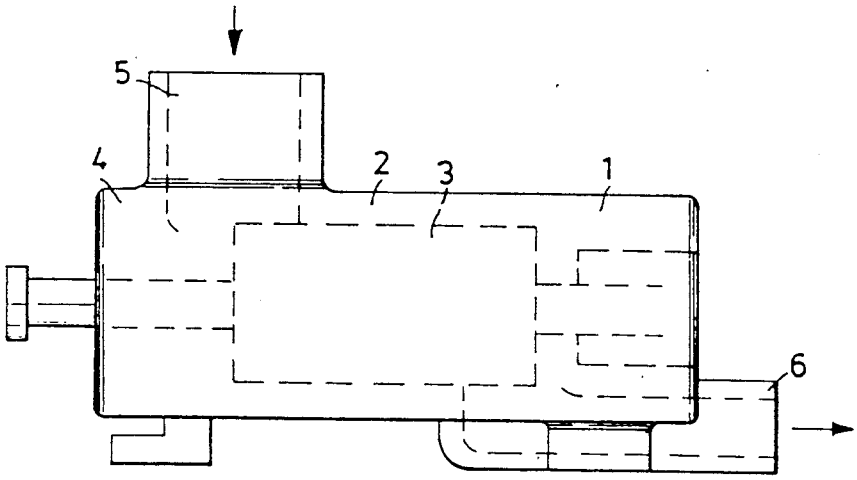

The present invention relates to a pressure actuated lift valve in a machine of the rotary screw type mounted in one of the end walls of the machine and containing a valve member being displaceable in an axial boring, one end of the boring facing the working space of the machine.

A machine of the rotary screw type contains two rotors mounted in a working space, which is limited by two end walls and a barrel wall extending therebetween. The barrel wall has the shape of two intersecting cylinders, each housing one of the rotors. Each rotor is provided with helically extending lobes and grooves, being in intermesh to form chevron-shaped compression or expansion chambers. In these a gaseous fluid is displaced and, when working as a compressor, compressed from an inlet channel to an outlet channel. Each compression chamber during a filling phase communicates with the inlet, during a compression phase undergoes a continuous reduction in volume and during a discharge phase communicates with the outlet.

Machines of this kind often are provided with valve means for regulating the built-in volume ratio or the capacity or for other purposes. When continuous regulation is required usually slide valves are used whereas at simpler regulation needs it might be sufficient to use lift valves. Such a valve is mounted in the barrel wall of the machine or in one of the end walls, normally the high pressure end wall. An example thereof is disclosed in U.S. Pat. No. 2,519,913.

In a pressure actuated lift valve of the specified kind using the outlet pressure for actuating, it is necessary that the surface exposed to the actuating pressure is larger than the surface facing the working chamber in order to attain a sufficient actuating force. In the embodiment in U.S. Pat. No. 2,519,913 where the lift valve solely is actuated by pressure (see FIG. 9) the valve member therefore has the form of two discs of different diameters rigidly connected by a rod. The disc of the smaller diameter constitutes the active valve member and is exposed to the working space of the compressor whereas the disc of the larger diameter is affected by actuating pressure. In the Swedish published Patent Application 8600427-2 a lift valve is disclosed, in this case mounted in the barrel wall, where the valve member in a similar way has two sections of different diameters in order to attain a surface large enough for the actuating pressure to act on.

The way to attain a sufficient surface for the actuating pressure to act on, used in the referred publications entails manufacturing problems, as it requires a precise centering of the two sections of valve member to the respective surrounding borings or cylinders. This problem is particularly accentuated if the two sections of the valve member are eccentric relative each other, since the eccentricity of these sections in this case has to correspond precisely to the relative eccentricity of the two borings.

Th object of the present invention therefore is to attain a valve of the kind in question where this problem is overcome.

This has according to the invention been achieved in that the valve member in a valve of the introductionally specified kind is cylindrical and is controlled by a separate actuating piston being displaceable in a cylinder (14), which actuating piston (12) is not joined to the valve member (11) and acts upon the valve member (11) by contact forces.

Thanks to the departure from the conventional technique where the valve member has sections of different diameters and instead make the valve member as a cylindrical piece of uniform shape the manufacturing complications discussed above are avoided, and by means of the separately made actuating piston a sufficient surface for the actuating pressure to act on is attained.

The assembly of the valve thus is considerably facilitated as it only requires to insert the valve member into the boring made therefor and then the actuating piston into its boring. Since each of the valve member and the actuating piston is made as a plain cylindrical part the manufacture of these will be particularly simple, whereas a valve member according to known technique requires tooling under precise centering. The simple manufacture will remain also if the borings are eccentric relative each other, whereas the manufacture of a valve member of the known kind will be considerably more complicated, since it has to be tooled to an eccentricity which exactly corresponds to that of the borings.

The invention will be described more in detail through the following description of a preferred embodiment thereof and with reference to the accompanying drawings of which:

FIG. 1 schematically shows a rotary screw compressor and

Figure 2:
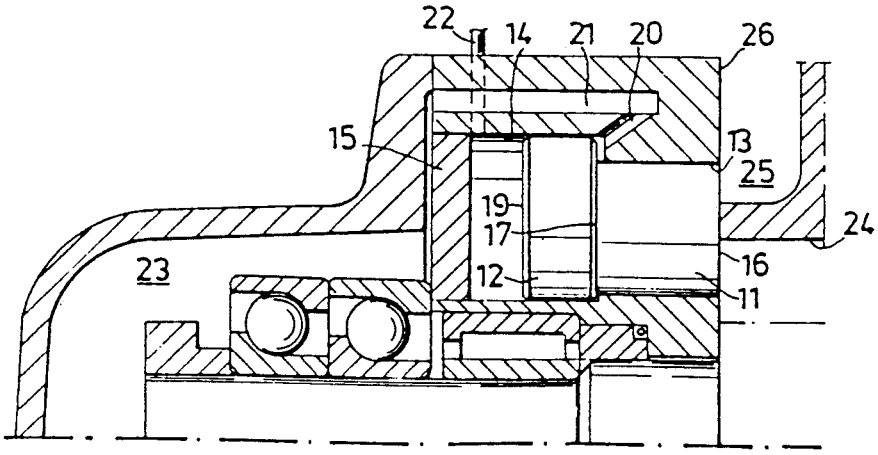

FIG. 2 shows a lift valve according to the invention.

Fig. 1 schematically shows the structure of a rotary screw compressor of the kind to which the invention relates. The compressor has a casing consisting of a low pressure end wall 4, a high pressure end wall 1 and a barrel wall 2 extending therebetween. The casing encloses a working space, in which a pair of intermeshing rotors 3 work, whereby fluid is sucked from the inlet channel 5 and is compressed and transported in chevron-shaped compression chambers to the outlet channel 6. Such a compressor should be so dimensioned that the pressure in a compression chamber at the moment of its opening towards the outlet channel 6 equals the pressure in the outlet channel 6. The pressure in the outlet channel, however, can change. If this pressure becomes lower than the pressure for which the compressor is made, the working fluid will be overcompressed, resulting in a decrease in efficiency. By providing a valve, which can bring a compression chamber into communication with the outlet channel 6 at an earlier momemt than through the fixed outlet port, the built-in volume ratio of the compressor can be lowered so that the end pressure in the compressor becomes adapted to the lower pressure in the outlet channel 6. In order to adapt the compressor to variations in the demand of compressed fluid it is possible also to provide it with valve means for regulating the capacity.

FIG. 2 shows a valve according to the invention mounted in the high pressure end wall of a rotary screw compressor. The lift valve shown has the function to regulate the built-in volume ration in a manner briefly described above. The valve contains a cylindrical valve member 11 having straight end surfaces 16, 17 and being axially movable in a boring 13, one end thereof facing the working space 24 of the compressor. The surface 16 of the valve member 11 facing the working space 24 is exposed partly to the working space 24 and partly to a space 25 in commucication with the outlet channel. In closed position, as shown in the figure, the surface 16 of the valve member 11 facing the working space 24 is coplanar with the inner surface 26 of the end wall. The other end of the boring 13 faces a cylinder 14 of larger diameter than the boring 13, in which cylinder 14 an axially movable actuating piston 12 is mounted. The cylinder 14 is closed by a disc 15. The actuating piston 12 and the valve member 11 are not joined to each other but are made as separate units. The cylinder 14 is provided with a channel 20, 21 at the end thereof adjacent to the boring 13, which channel leads to a space 23 outside the cylinder. Said space 23 communicates through a channel, not shown, with a closed compression chamber in the compressor, where the pressure is slightly above inlet pressure. The other end of the cylinder 14 is through a channel 22 connected to a two-way valve, not shown, through which said channel 22 can be connected either to the inlet channel or to the outlet channel. The boring 13 and the cylinder 14 are in the shown embodiment eccentric relative to each other, which allows more space for journalling the rotor and thus greater freedom for the locating and dimensioning of the bearings.

When the compressor works against a pressure in the outlet channel being at least as high as the end pressure in a compression chamber the valve is kept in closed position. This is accomplished by having the channel 22 connected to outlet pressure. Thereby outlet pressure will act on the left side 19, as seen in the figure, of the actuating piston 12. The actuating piston 12 and the valve member 11 are so dimensioned that the force attained through this pressure is greater than the opposite directed forces, i.e. the contact force from the valve member 11 on the actuating piston 12 and the force resulting from the pressure acting on the part of the right end surface of the actuating piston 12 not being covered by the valve member 11. This pressure is about the same as the pressure in the closed working chamber with which the right end of the cylinder 14 communicates through the channel 20, 21 and the space 23, i.e. slightly above inlet pressure. The contact force from the valve member 11 on the actuating piston is a result of the pressures acting on the right side of the valve member 11. These are the pressure from the working fluid in a compression chamber just before it opens, acting on a part of the end surface 16 of the valve member 11 and the pressure from the working fluid in the space 25 connected to the outlet channel, acting on the remaining part of said end surface 16.

If the pressure in the outlet channel should become smaller than the end pressure in the compressor the valve is opened. This is accomplished by connecting the channel 22 to the inlet channel by means of the two-way valve, whereby the pressure on the left side of the actuating piston 12 decreases and no longer is able to overcome the forces directed leftwards. Therefore the valve member 11 and the actuating piston 12 are pushed leftwards in the figure and reach a position in which the valve opens communication between the working space and the outlet channel, resulting in a lower end pressure in the compressor.

I claim:

1. A pressure actuated lift valve in a machine of the rotary screw type mounted in one of the end walls of the machine and containing a valve member (11) being displaceable in an axial boring (13), one end of the boring (13) facing the working space (24) of the machine, characterized in that the valve member (11) is cylindrical and controlled by a separate actuating piston (12) being displaceable in a cylinder (14), which actuating piston (12) is not joined to the valve member (11) and acts upon the valve member (11) by contact forces.

2. A valve according to claim 1, in which said cylinder (14) is axially directed and the second end of said boring (13) completely debouches in said cylinder (14).

3. A valve according to claim 2, in which said actuating piston (12) contacts said valve member (11) for transferring said contact forces.

4. A valve according to claim 3, characterized in that the boring (13) for the valve member (11) and the cylinder (14) for the actuating piston (12) are eccentric relative each other.

5. A valve according to any of claim 1 to 4, in a machine working as a compressor, which valve is mounted in the high pressure end wall of the compressor and controls the built-in volume ratio of the compressor.

* * * * *

UNITED STATES PATENT AND TRADEMARK OFFICE

CERTIFICATE OF CORRECTION

PATENT NO. : 5,052,901

DATED : October 1, 1991

INVENTOR(S) : Arnold ENGLUND

It is certified that error appears in the above-identified patent and that said Letters Patent is hereby corrected as shown below:

Title page, item: [56] References Cited, insert the following references:

U.S. PATENT DOCUMENTS -

| | | |
|---|---|---|
| 2,519,913 | 8/1950 | Lysholm |
| 3,088,659 | 5/1963 | Nilsson |
| 4,737,082 | 4/1988 | Glanvall |

FOREIGN PATENT DOCUMENTS -

| | | |
|---|---|---|
| 218 783 | 2/1968 | Sweden |

Signed and Sealed this

Twenty-eighth Day of June, 1994

Bruce Lehman

BRUCE LEHMAN

*Commissioner of Patents and Trademarks*

*Attest:*

*Attesting Officer*